United States Patent [19]

Foresto

[11] 4,317,417

[45] Mar. 2, 1982

[54] INCINERATOR APPARATUS AND METHOD OF UTILIZING THE CLEANED WASTE GASES THEREOF

[76] Inventor: Samuel Foresto, 243 Willis Ave., Mineola, N.Y. 11501

[21] Appl. No.: 221,974

[22] Filed: Jan. 2, 1981

[51] Int. Cl.[3] ..... F23B 5/00

[52] U.S. Cl. ..... 110/211; 110/210; 110/212; 110/213; 110/216; 110/345; 422/182

[58] Field of Search ..... 110/210, 211, 212, 213, 110/214, 345, 216; 431/5; 422/182

[56] References Cited

U.S. PATENT DOCUMENTS

| | | | |
|---|---|---|---|
| 2,678,616 | 5/1954 | Kay . | |
| 3,365,858 | 1/1968 | Penney . | |
| 3,485,190 | 12/1969 | Pelletier . | |
| 3,511,194 | 5/1970 | Stookey . | |
| 3,526,196 | 9/1970 | DeSeversky . | |
| 3,532,078 | 10/1970 | Foresto . | |
| 3,560,165 | 2/1971 | Beasley | 431/5 X |
| 3,615,248 | 10/1971 | Holler | 110/210 X |
| 3,730,112 | 5/1973 | Hutchinson et al. . | |
| 3,832,144 | 8/1974 | Wieken et al. . | |
| 4,091,747 | 5/1978 | Chase | 110/210 |
| 4,126,419 | 11/1978 | Katabuchi et al. . | |
| 4,205,614 | 6/1980 | Good | 110/216 X |

*Primary Examiner*—Edward G. Favors
*Attorney, Agent, or Firm*—Bauer & Amer

[57] ABSTRACT

A method and incinerator apparatus for cleaning and utilizing the waste gases thereof to perform work after the residue and particles that pollute and contaminate the same are removed therefrom. After the waste gases are subjected to and scrubbed at high temperatures to burn and consume the particles and residue, remaining particles and residue are further separated in a heat accumulator from which the higher temperature waste gases are used as an aid in the scrubbing and cleaning the lower temperature waste gases and from which the heat of the waste gases is extracted for the performance of work.

38 Claims, 2 Drawing Figures

INCINERATOR APPARATUS AND METHOD OF UTILIZING THE CLEANED WASTE GASES THEREOF

Figure 1:
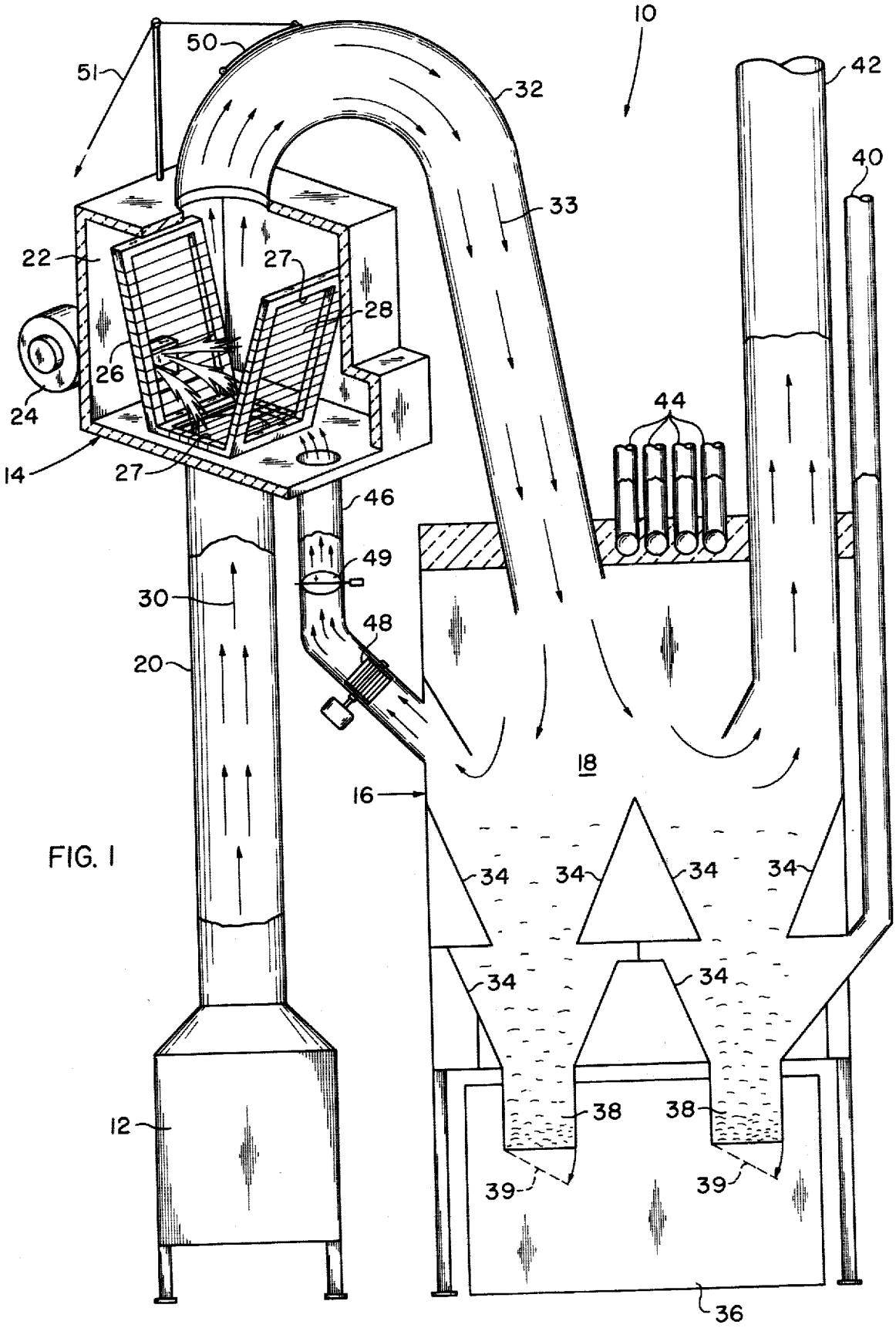

The present invention relates to incinerator apparatuses and methods for cleaning the waste gases of the incinerator and utilizing the heat thereof.

In incinerator apparatuses it has been the practice to attempt to clean the waste gases of the noxious contaminating or polluting particles in the form of residue that remain contained therein by subjecting the gases to various scrubbing procedures. Some of these scrubbing procedures include washing the waste gases; others include subjecting the waste gases to an afterburning procedure while others may include ionizing and variations or combinations of these.

Waste gases emitted in the disposal of waste by incineration are known to contain a considerable amount of residue in the form of unburned particles. The unburned particles are the product of the incomplete combustion that occurs during the incomplete incineration process. The residue that is entrained in the waste gases in the form of minute or large particles pollute and contaminate such gases that rise from the incinerator and are discharged directly into the atmosphere with their toxic and harmful materials. When such polluted and contaminated waste gases are discharged into the atmosphere, they emit noxius odors and fumes that are sometimes dangerous and harmful to the health of the surrounding population, animals and vegetation.

The desideratum of the present invention is to provide a novel arrangement of incinerator apparatus including a chimney structure that directs the flow path of the residue bearing waste gases such that the same flow in an essentially closed path in which the contaminating particles are subjected to high temperatures that burn and consume them before the waste gases are discharged into the atmosphere.

An object of the invention is to provide a means for scrubbing the waste gases by subjecting the same to sufficiently high temperatures that the residue entrained therein in the form of particles are burned and consumed.

Another object of the invention is to utilize the clean hot waste gases before they are discharged into the atmosphere by directing them to a heat accumulator where the heat of such gases is extracted for the performance of work.

Still another object of the invention is to provide an apparatus wherein the waste gases are caused to follow a flow path that imparts a movement to the polluting and contaminating particles remaining in the waste gases after they have been scrubbed such that the remaining particles separate from the waste gases in the heat accumulator.

Still other features and objects of the invention reside in the structural details that enable the operation of the scrubber either with the use of electrical heaters, fluid fuel burners, and/or with the combination of both; and to provide for convenient access to the scrubber and chimney structures for repair thereof while permitting the use of the high heat of the cleaned waste gases so that they may be diverted back to the scrubber to supplement the heat of the scrubber in burning and consuming the contaminating and polluting particles in the waste gases emitted by the incinerator.

Figure 2:
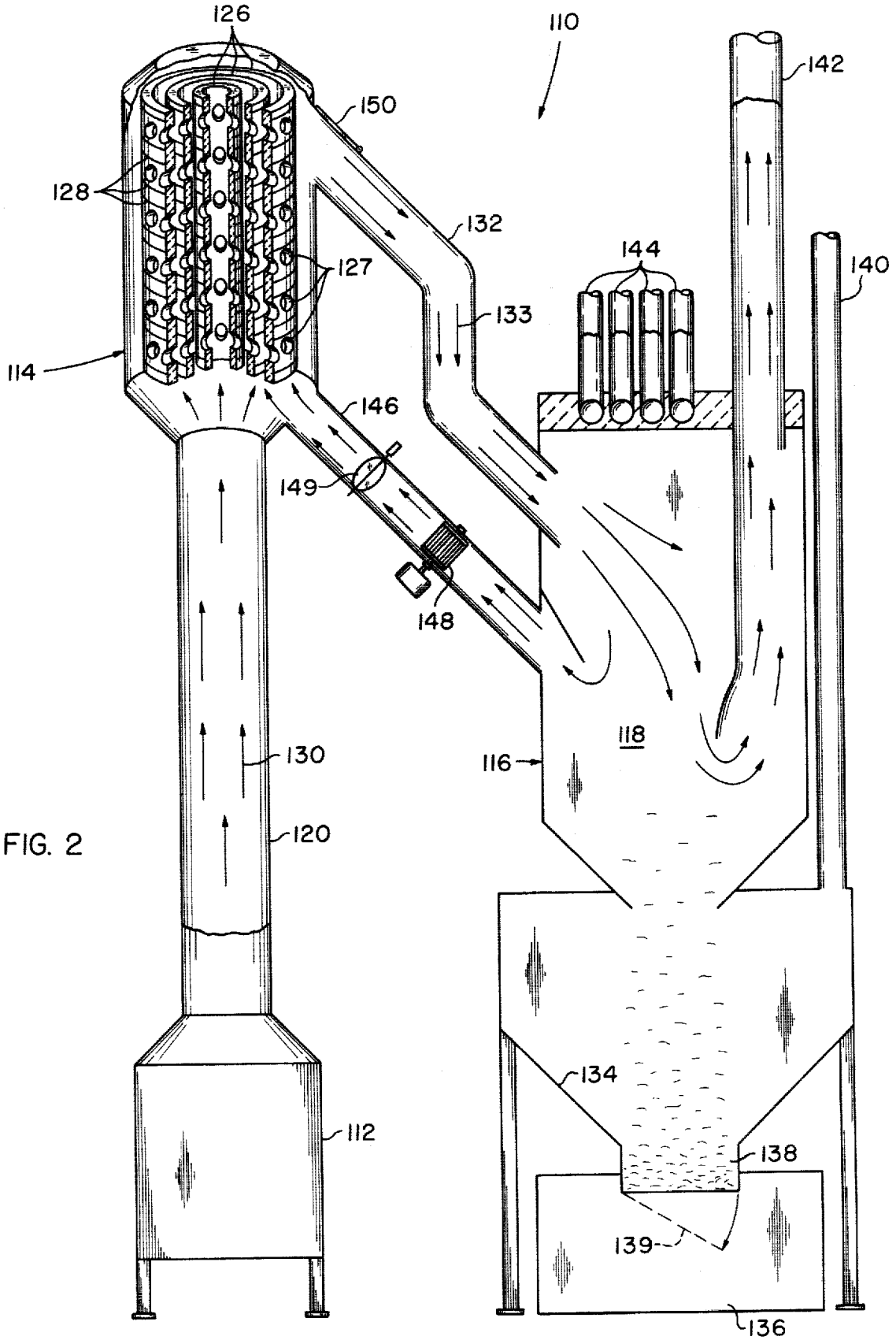

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

FIG. 1 is a diagrammatic illustration of an incinerator apparatus constructed according to the invention; and FIG. 2 is a diagrammatic illustration of another embodiment of the incinerator apparatus constructed according to the invention.

Referring to the drawings, and more particularly to FIG. 1 thereof, the same illustrates an incinerator apparatus generally identified by the numeral 10. The term "incinerator" as here used is intended to be broadly interpreted as a furnace, a fireplace or any other convenient form of burning structure indicated by the numeral 12. Thus, the use of the term incinerator in the present application is intended to include all such devices that may be utilized to burn or consume articles that result in the production of waste gases which have entrained therewithin a residue of unburned particles that contaminate and pollute the waste gases and the atmosphere when so discharged thereinto.

It is the intention of the present invention to remove such residue and particles from the waste gases and thereafter permit the cleaned waste gases to be utilized for the performance of work. Subsequently the used water gases may be discharged into the atmosphere in cleaned condition. To this end there is included within the apparatus 10 a scrubber structure that is generally identified by the numeral 14 and a heat accumulator 16 having an interior heat accumulator chamber 18.

A chimney is included in the incinerator apparatus 10 to connect the incinerator 12 and conduct the flow of its waste gases directly to the scrubber structure 14, and from there directly to the heat accumulator chamber 18 of the accumulator 16. Because the flow of movement of the waste gases emitted from the incinerator is controlled in its path by the chimney, the chimney includes a number of ducts. The duct 20 forming a part of the chimney structure directly connects the incinerator 12 with the scrubber structure 14 to assure that the waste gases emitted by the incinerator 12 enter into an interior chamber 22 of the accumulator structure 14.

The scrubber chamber 22 is illustrated as having a fluid fueled burner 24 that is shown in the form of an oil or gas burner. The nature of the fuel used at the burner 24 is immaterial. However, the exit of the flame of the burner 24 is directed into the interior chamber 22 of the scrubber 14 and located immediately adjacent to the topmost opening of the duct 20 into such chamber. The position of the burner flame will assure that as the waste gases flow into the chamber 22 by way of the duct 20, such waste gases immediately come into contact with the flame of the burner 24 that is positioned directly above the opening of the vent 20. The result is that the residue of contaminating and polluting particles contained within the waste gases entering the chamber 22 is immediately subjected to the heat of the flame of the burner 24 to cause them to be burned and consumed rapidly within the scrubber 14.

The term scrubber as used herein is not intended to be limited to any specific arrangement of structural details. Although scrubbers have been known to utilize fluids to wash waste gases of contaminating residue or particles, in the present disclosure the scrubber 14 is used for a similar purpose. However, in the present invention the scrubber 14 utilizes heat higher than that of the incinerator and sufficient to burn and consume the entrained particles. Hence, the term scrubber is intended to be interpreted in the present application as a structure that removes from the waste gases the residue and particles that may be entrained therein after the waste gases leave the incinerator 12.

Illustrated within the scrubber chamber 12, in addition to the fire of the fluid fueled burner 24, is an electrically operated burner or heater 26. The burner or heater 26 may include a frame about which are wound a series of electrical heating coils 28 that receive their electricity from a conventional source, not shown, and form no part of the invention. The electrical burner or heater 26 is of openwork construction with large openings 27 defined therein. The area of the openings 27 is such as to permit the gases flowing upwardly in the direction of the arrows 30 to flow into the chamber 22 and through the large openings of the electrical heater framework 26 without being restricted in their flow path. Ideally the open spaces 27 defined in the framework of the heater 26 are of sufficient area as to accommodate the volume of flow of the waste gases by way of the duct 20 and to permit the waste gases to flow outwardly from the top of the scrubber 14 without being slowed in their path of movement.

The electrically operated coils 28 become extremely hot and, therefore, produce a flame which, in conjunction with the flame of the fluid fueled burner 24, heats the waste gases entering into the scrubber chamber 22 to a temperature that is substantially higher than that of the temperature of the waste gases flowing in the duct 20 from the incinerator 12. Although the fluid fueled burner 24 and the flame being produced thereby into the chamber 22 will, by itself, generate a temperature that is purposely higher than that of the temperature of the waste gases in the duct 20 therebelow, the addition of the electrical heater element 26 and its coils 28 increases the temperature within the scrubber chamber 22 such that the waste gases that flow upwardly into the chamber 22 from the duct 20 and the particles entrained in the waste gases immediately come into contact with the flame to be burned and consumed thereby.

In the event the flame is insufficient to completely consume the particles in the waste gases, then the electrical heater 26 will add to the temperature of the waste gases in the scrubber to ignite what residue and particles may remain entrained in the waste gases. In practice, if the heat of the flame of the fluid fueled burner 24 is great enough at the exit at the top of the duct 20 to burn off and consume the particles in the waste gases, then there is no need for the further electrical burning means 26. In like manner, if the heat produced by the electrical scrubbing element 26 and its coil 28 is great enough to burn and consume the contaminating particles in the waste gases directed into the scrubber by the chimney duct 20, then it is possible to eliminate the use of the fluid fueled burner 24.

However, it is preferable that when the fluid fueled burner 24 is utilized, some form of igniting means should be contained within the chamber 22 of the scrubber 14. For this reason the illustration of FIG. 1 shows the combination of both the fluid fueled burner 24 and the electrical igniter means 26 with its burner coils 28. When a fuel burner is used by itself in the scrubber 14, if a condition should occur whereby the flame of the fuel burner is accidentally extinguished, the further pumping of fuel into the chamber 22 in the absence of a flame will result in the accumulation of fuel in the chamber 22, which, if the fuel is subsequently ignited, may cause an explosion.

To avoid the possibility of an explosive condition by reason of the improper operation of the fluid fueled burner 24 within the chamber 22, the igniter means 26 is also included therewithin to operate in combination with the burner 24. Because the igniter 26 will constantly be in operation, its live coils 28 will present the condition of a spark that is constantly available for the ignition of whatever unburned fuel may enter the chamber 22 of the scrubber 14, either from the burner 24 pumping the same thereinto, or by reason of fuel entering such chamber from any other source. Thus, the presence of the ignitor 26 and its heated coils 28 within the chamber 22 prevent the possibility of an explosive condition occurring within the scrubber 14.

Although the afterburner effects of the scrubber 14 remove substantially all of the unburned residue or particle impurities that may remain entrained within the waste gases flowed into the scrubber 14 by the chimney duct 12, there is a possibility that some impurities may not be burned and consumed. Recognizing this possibility the chimney connects the top of the scrubber 14 with the heat chamber 18 of the heat accumulator 16 by a further chimney duct 32 which directs the flow path of the waste gases from the top of the scrubber 14 in the direction of the arrows 33. Because of the higher temperature of the waste gases at the top of scrubber 14, they rise rapidly out of the chamber 22 and enter the chimney duct 32 at a very high speed or velocity of movement.

Naturally the waste gases entering the chimney duct 32 at the top of the scrubber 14 are at a temperature that is predeterminately set substantially higher than that of the waste gases in the chimney duct 20 that enter into the scrubber from the incinerator 12. By reason of their extreme heat the waste gases exiting from the scrubber 14 are moving rapidly and are extremely turbulent. They rise rapidly and turbulently into the duct 32 to be conveyed thereby and directed downwardly into the heat accumulator chamber 18 of the accumulator 16. Because of the turbulence of the higher temperature waste gases in the chimney duct 32, and because of the downward direction in which the gases are forced to flow by the chimney duct 32, whatever residue or contaminating particles may remain in the waste gases flowing in the path 33 have imparted to them a velocity of movement in a downward direction toward and into the chamber 18.

The heat chamber 18 is of a substantially larger volume than is the relatively smaller cross-sectional area of the chimney duct 32 that exhausts and directs the waste gases thereinto. Hence, when the waste gases flow into the enlarged chamber 18 they tend to lose their momentum by expanding rapidly within the larger space of the heat chamber 18. However, because the contaminating residue and particles have some mass and are incapable of expanding, they continue in their downward direction of movement and more readily separate from the expanding waste gases. As the residue or particles separate from the waste gases and lose their momentum, they then fall, by reason of their own weight and under the influence of gravity, downward toward the bottom of the heat chamber 18.

Provided at the bottom of the heat chamber 18 are a plurality of ramps 34 that direct the falling particles further downward into a receptacle or particle receiving container 36 therebelow. The container 36 is positioned beneath a plurality of chutes 38 that may have closure doors 39 to prevent the upward flow of particles back into the heat accumulator chamber 18. When the container 36 is filled or at least partially filled, it may be removed and a new empty one substituted in its place.

To prevent the possible creation of a vacuum within the container 36, there is provided an air vent 40 that vents the container 36 and the chute area beneath the accumulator chamber 18 to the atmosphere. In like manner, vent means 42 are also included to vent the interior of the heat chamber 18 to the atmosphere. The combination of the venting means 40 and 42 obviate the possibility that a closed condition will occur within the heat accumulator chamber 18 or the container 36 and thereby assure that there is a continuous downward chimney flow of waste gases into the heat accumulator chamber 18 from the chimney duct 32.

Provided within the heat accumulator 16, and being in flow connection with the chamber 18 thereof, are a plurality of heat exchanger ducts or work performing passages 44. The passages or ducts 44, being in intimate communication with the heat accumulator chamber 18, and preferably positioned at the high point thereof, will be in the upward flow path of the highly heated waste gases within the chamber 18. Because the waste gases will rise, the heat of such gases is used for many purposes prior to venting the same to the atmosphere by way of the vent means 40 and 42 or at the ends of the passages or ducts 44. By providing heat exchanger ducts or passages 44 within the chamber 18 where the hot gases accumulate, it is possible to utilize the heat of the waste gases to perform useful work, as to heat other parts of buildings, operate turbines, generators and steam systems, and do whatever work may be performed thereby. Thus, for example, it is possible to divert, by way of the ducts or passages 44, the heated gases to heat the tubes of a steam boiler or hot water or hot air systems.

The consumption of fuel and electricity at the scrubber 14 is appreciably reduced by diverting some of the higher temperature waste gases from the heat accumulator chamber 18 back into the scrubber 14. This may be accomplished by providing an additional recycling conduit or duct 46 that is in direct communication between the heat chamber 18 and the scrubber 14 in the manner shown in FIG. 1. There the recycling duct 46 is preferably positioned at a point lower than the entrance point of the chimney duct 32 into the heat chamber 18. This enables the hot gases that rise in the chamber to flow upwardly along the duct 46 to recycle into the scrubber 14.

During conditions of high humidity or when materials being burned in the incinerator 12 have a high moisture content, the waste gases emitted upward along the chimney 20 will remain heavily laden with unburned residue and particles. The weight of such waste gases will inhibit and slow their rise upward along the chimney 20 and when they do reach the scrubber 14, their particulate content is so dense as to resist burning and consumption by the flame of the burner 24 or that of the flaming coils 28. This results in an accumulation of residue and particles in the scrubber that may produce a blow back condition or perhaps even smother the burner flame.

To avoid these build-ups and accumulations, and to aid in quickly drying the waste gases and their entrained residue and particles, advantage is taken of the hotter gases in the heat accumulator chamber 18. Such gases may be permitted to flow normally upward and continuously through the duct 46 to the scrubber 14 where their higher heat, coming in contact with the waste gases rising from the chimney 12, liberates the moisture from such rising waste gases and dries the residue and particles entrained therein. However, to assure a more constant and continuous circulation of hot drying gases from between the chamber 18 and the scrubber 14, the recycled and recirculation flow from between the scrubber and the chamber 18 is encouraged and pressurized by a motor driven blower illustrated at 48.

The blower 48 may be included within the duct 46. The pressurized flow of higher temperature gases from the chamber 18 into the scrubber 14 produces a strong forced draft upward into the scrubber 14 that recirculates the waste gases along the chimney duct 32 back into the chamber 18. This forced updraft and recirculation supplements and adds to the updraft of the waste gases rising in the chimney duct 20. In addition, it quickly dries the waste gases and their entrained residue and particles while forcefully separating such residue and particles so as to prevent particulate bunching that would result in accumulation of large masses in the scrubber that would result in inhibiting the proper functioning of the scrubber.

The constant and continuous updraft by way of the recycling duct 46 aids in the upward flow of the particulate laden waste gases into and through the scrubber 14 by way of the chimney 20. A flapper valve 49 is included within the recycling duct 46 for selective manipulation to open fully, close fully or partially obstruct the recycling flow of gases between the chamber 18 and the scrubber 14.

The present invention teaches a relatively closed system in which the waste gases are substantially, if not fully, cleaned within the scrubber, and are than directed immediately from the scrubber into the heat accumulator chamber 18 for the final separation of remaining contaminants from the gases and for the performance of work thereby by ducting the waste gases with heat exchangers or other work performing devices in communication with the chamber 18.

In the event it becomes necessary to repair the incinerator apparatus 10, an access opening to the chimney structure is afforded in the form of a door 50 in the chimney duct 32. The door may be operated manually by the chain 51 or automatically by operating the chain 51 by means of a motor drive, not shown. By providing access to the interior of the chimney duct 32, it is now possible to enter into the scrubber 14 and repair whatever problem may exist therein. In addition, by opening the access door 50, the same provides an exit for the flow of waste gases upwardly from the scrubber to the atmosphere in the event it becomes necessary to vent such gases directly into the atmosphere. The ability to direct the flow of the waste gases directly into the atmosphere by way of the access door 50 enables repair of the attendant structure downstream of the chimney duct 32, namely, the details of structure contained within the heat accumulator 16 and the ducts and passages associated therewith.

Referring to the embodiment of the incinerator apparatus illustrated in FIG. 2, the same is generally identified by the numeral 110. For the convenience of the reader and for ease of explanation, elements in the embodiment of the incinerator apparatus 110 will be identified by the same 10's digits as were used to identify like elements in the incinerator apparatus 10 of FIG. 1. Thus, for convenience the numerals utilized in describing the elements of the apparatus 110 will be numbered in the 100 series. It will be recognized that because there are like elements in the apparatus 10 and 110, a duplication of the description of such elements would only be redundant. Therefore, wherever possible such duplicate descriptions will be avoided.

In the apparatus 110 of FIG. 2 the hot gases travel along a flow path 130 directed by the chimney duct 120 from the incinerator to the scrubber structure 114. The scrubber structure 114 is positioned in a vertical direction so as to receive the rising hot gases at the base thereof. Although the scrubber structure is illustrated as being circular, it is not to be deemed to be so limited. The scrubber 114 may be of any other shape or configuration that will enable it to perform in accordance with the teaching of the invention. As shown, it includes within it a plurality of concentrically arranged rings 126. The rings 126 may be of a ceramic material that supports a plurality of electrically operated wires 128 that are electrically driven to extremely high temperatures by a source that is not shown. The temperatures produced by the coils of wires 128 are predetermined to produce a temperature that is much greater or higher than that of the temperature of the waste gases that flow in the direction of the arrows 130 along the chimney duct 120 and into the scrubber structure 114.

As the waste gases rise and exit into the scrubber 114 from the chimney duct 120, they circulate about and between the contentric heating rings 126 and burning coils 128. To assure the proper burning, combustion and consumption of whatever residue or particles exist in the waste gases, the rings 126 are of a porous type construction wherein a plurality of openings 127, here shown in the form of small holes, are provided to enable the waste gases to flow laterally between each of the rings. This more fully subjects the gases and the particles of contamination entrained in the waste gases to come into full burning and consuming contact with the electrical elements 128 and with the hot supporting rings 126. The heat generated by the electrical elements 128 causes the whole of the structure 126, 128 to achieve a hot mass of the predetermined temperature that is higher than that of the waste gases entering the scrubber 114 as to burn and consume substantially all of the particles of contamination entrained in such waste gases.

The top of the scrubber 114 is closed and thereby prevents the exhaust of the waste gases directly outward from the scrubber into the atmosphere. As in the prior embodiment, it is the purpose of the present invention that the cleaned or scrubbed waste gases contained within the scrubber itself achieve such a high degree of heat and temperature that the gases themselves turbulate and assume the flow of currents vertically and laterally within the scrubber thereby causing the gases to move up and down and sideways between the scrubber heating elements 126 and 128 to fully clean the gases. When the gases reach the top of the scrubber and bounce back down off the same, they are once again reintroduced into intimate contact with the heating elements 126, 128. This construction is effective to clean the gases of their contaminating particles.

However, the hottest gases tend to accumulate at the top of the scrubber 114 and are, therefore, diverted and directed away from the scrubber 114 by the chimney duct 132 in the direction of the flow path indicated by the arrows 133. In the embodiment of the apparatus 10 shown in FIG. 1 and in the present embodiment 110 as here illustrated in FIG. 2, the chimney duct 132 illustrates the flow path of the cleaned waste gases to be directed downwardly toward and into the chamber of the heat accumulator. In actual practice the ducts 32 and 132 are directed substantially laterally away from the scrubber and caused to exit into the heat accumulator chamber 118 adjacent thereto.

For purposes of description the downward diversion of the waste gases in the direction of the flow path 133 is illustrated to enable the reader to recognize that the separation of contaminating particles or residue entrained within the waste gases is accomplished more rapidly when the waste gases and their entrained particles of contamination are given a downward velocity and movement so as to cause a violent physical separation of such particles from the waste gases by reason of their own momentum and under the influence of gravity acting upon them. It is for this reason that the illustrations of the embodiments 10 and 110 in FIGS. 1 and 2 respectively show the chimney ducts 32 and 132 in a downward direction toward the heat accumulator chambers 18 and 118 respectively.

When the waste gases are directed away from the top of the scrubber 114 into the heat accumulating chamber 118 of the heat accumulator 116, the gases enter the chamber of greater volume than afforded by the cross-sectional area of the duct 132. Almost immediately the gases tend to lose their momentum within the larger space of the chamber. However, the velocity of movement imparted to the mass of particles entrained within the waste gases cause the particles to continue to flow beyond the slowed expanding waste gases and separate from the waste gases by falling downwardly to the bottom of the heat accumulator chamber 118.

The high temperature of the waste gases in the heat accumulator chamber 118 are now utilized to perform useful work by ducting the same along the passages 144 for whatever purpose may be desired. To improve the flow of the waste gases within the chamber 118, the same is vented to the atmosphere at 142 while the container 136 is also vented to the atmosphere by the vent means 140. The heat of the high temperature waste gases within the heat chamber 118 is further utilized by diverting some of such gases back to the lower portion of the scrubber structure 114 by way of the duct 146. The duct may include a flow assisting blower 148 and a closable flapper valve 149 if communication between the accumulator 116 and the scrubber 114 is required to be closed.

Although the apparatus and method here described involve an essentially closed system that forcefully cause the flow path of the waste gases to move directly from the hottest portion of the scrubber 114 to the heat accumulator 116, there is provided an access door and opening 150 that may be conveniently positioned either at the top of the scrubber 114 or adjacent thereto on the chimney duct 132 as shown by the numberal 150.

In the event repair of any part of the apparatus is required, the access door 150 may be opened to afford access to the interior of the scrubber and chimney structure. If operation of the incinerator 112 is continued during the time that the access door 150 is open, the flow path of the waste gases from the scrubber 114 to the heat accumulator 116 may be interrupted and diverted directly into the atmosphere. This will enable repair of the accumulator structure without affecting the operation of the incinerator and scrubber structures. However, if access is required to the scrubber, it should be apparent that the operation of the incinerator 112 must be terminated.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An incinerator apparatus comprising an incinerator and a chimney connected with said incinerator and along which waste gases are directed to flow therethrough from the incinerator, a scrubber connected with and substantially directly above said incinerator by said chimney and through which the waste gases are flowed, said scrubber including means to consume residue entrained in the waste gases to scrub clean the waste gases of the residue, a heat accumulator connected by said chimney with said scrubber and below the same, said heat accumulator having a heat accumulator chamber of larger volume than the cross-section of said chimney, said chimney including means connecting said scrubber with said accumulator to conduct the scrubbed waste gases to exhaust the same directly from said scrubber to said accumulator, and means in said accumulator for directing the flow of the waste gases therefrom for performing work by extracting heat from such waste gases.

2. An incinerator apparatus as in claim 1, said means to consume the residue being a heater for heating the waste gases passing through said scrubber to a temperature higher than that of the waste gases leaving said incinerator and said higher temperature being sufficient to burn the residue to consume the same to scrub clean the waste gases.

3. An incinerator apparatus as in claim 2, said heater being electrically operated.

4. An incinerator apparatus as in claim 2, said heater being a fluid fueled burner.

5. An incinerator apparatus as in claim 2, said heater including an electrically operated heating member and a fluid fueled burner in said scrubber through which the waste gases are directed to flow by said chimney.

6. An incinerator apparatus as in claim 2, conduit means connecting said accumulator with said scrubber to divert back to said scrubber a portion of the higher temperature waste gases in said accumulator to utilize the heat of the diverted waste gases to supplement the residue consuming heat of said scrubber to aid in consuming and scrubbing clean in said scrubber the residue entrained in the waste gases and including means to maintain a continuous recycling of pressurized waste gases between said scrubber and accumulator to effect a continuous draft in said scrubber.

7. An incinerator apparatus as in claim 2, means in said chimney providing access thereto and to said scrubber for repair and venting thereat of the waste gases from said chimney.

8. An incinerator apparatus as in claim 1, said chimney connection means between said scrubber and accumulator being disposed angularly downward from the top of said scrubber to divert the waste gases flowing from said scrubber to said accumulator in a downward direction to impart to the waste gases and to residue still entrained in the waste gases a downward velocity of movement into said accumulator chamber where the waste gases expand and lose their movement while the velocity of movement separates the residue from the waste gases to fall therefrom, and a residue storage container beneath said accumulator chamber to receive and store the separated residue.

9. An incinerator apparatus as in claim 8, means venting said container means and accumulator to the atmosphere.

10. In an incinerator apparatus having an incinerator, an accumulator chamber, a chimney for conveying the flow of waste gases along a path from said incinerator to said accumulator chamber in which the heat of the waste gases accumulates and is used to perform work, scrubber means downstream of and substantially above said incinerator and along the flow path of the waste gases to said accumulator chamber, said scrubber including means to heat the waste gases to a temperature higher than that of the waste gases leaving the incinerator by way of said chimney to burn off and consume particles entrained in the waste gases, said chimney including means directing the flow path of higher temperature waste gases turbulently downward from said scrubber directly into said accumulator chamber for the accumulation of heat therein for the performance of work thereby, and means connected with said accumulator chamber to use the higher temperature waste gases by extraction of the heat therefrom for the performance of work thereby.

11. In an incinerator apparatus as in claim 10, by-pass means in said incinerator apparatus to return to the flow path of the incinerator waste gases an amount of the higher temperature waste gases from said accumulator chamber to aid in the burning and consumption of particles entrained in the waste gases at said scrubber means.

12. In an incinerator apparatus as in claim 11, said chimney directing means being connected with said scrubber at the highest temperature of the flow path of the waste gases to cause the waste gases to flow in a downward path from said scrubber means to said accumulator chamber to impart to particles remaining in the waste gases a movement such as to separate such remaining particles from the waste gases when the waste gases lose their momentum in said accumulator chamber, and said accumulator chamber being of a volume greater than the cross-section area of said chimney such that the waste gases entering said accumulator chamber expand and quickly lose their momentum therein while the momentum of the particles remaining in the waste gases causes the same to separate and fall from the waste gases.

13. In an incinerator apparatus as in claim 12, container means connected with said accumulator chamber to collect the particles falling and separating from the waste gases.

14. In an incinerator apparatus as in claim 13, means connected with said accumulator chamber to vent the same to the atmosphere.

15. In an incinerator apparatus as in claim 10, said heating means being electrically operated.

16. In an incinerator apparatus as in claim 10, said heating means being a fluid fuel burner.

17. In an incinerator apparatus as in claim 10, said heating means including an electrically operated heating member and a fluid fueled burner in said scrubber through which the waste gases are directed to flow by said chimney.

18. In an incinerator apparatus as in claim 10, normally closed access means in said chimney operable to provide access to said scrubber means for the repair thereof and for the venting of waste gases therefrom to the atmosphere.

19. In an incinerator apparatus, an incinerator producing waste gases in which residue is entrained in the form of unburned particles, a scrubber having means to heat the waste gases to burn and consume unburned particles entrained in the waste gases, an accumulator chamber in which the heat of the waste gases accumulates after being heated by said scrubber and in which the heat is used to perform work, chimney means connecting said scrubber and accumulator chamber with said incinerator to direct the flow of the waste gases directly upward from said incinerator to said scrubber and from said scrubber downward to said accumulator, and ducts connected with said accumulator chamber and into which the waste gases flow from said accumulator chamber to enable the heat of the waste gases to be extracted therefrom for the performance of work thereby.

20. In an incinerator apparatus as in claim 19, said scrubber having an essentially closed housing with said chimney means directing the flow of the waste gases thereinto from said incinerator and directing the flow of waste gases outward therefrom directly to said accumulator chamber.

21. In an incinerator apparatus as in claim 20, said chimney having means to direct the flow of waste gases outward from the top of said scrubber housing and downward directly into said accumulator chamber to impart a separating force to unburned particles in the waste gases to cause the same to separate from the waste gases in said accumulator chamber.

22. In an incinerator apparatus as in claim 21, said heater being electrically operated.

23. In an incinerator apparatus as in claim 21, said heater being a fluid fueled burner.

24. In an incinerator apparatus as in claim 21, said heater including an electrically operated heating member and a fluid fueled burner in said scrubber through which the waste gases are directed to flow by said chimney.

25. In an incinerator apparatus as in claim 21, a storage container beneath said accumulator chamber to receive and store unburned particles separating from the waste gases, and means venting said container and accumulator chamber to the atmosphere.

26. In an incinerator apparatus as in claim 20, said scrubber housing being closed at its top, and said chimney having means to direct the flow of waste gases outward from below the closed top of said housing and downward into said accumulator chamber to impart a velocity of movement to the unburned particles remaining in the waste gases to cause the same to separate therefrom in said accumulator chamber.

27. In an incinerator apparatus as in claim 26, said heater being electrically operated.

28. In an incinerator apparatus as in claim 26, said heater being a fluid fueled burner.

29. In an incinerator apparatus as in claim 26, said heater including an electrically operated heating member and a fluid fueled burner in said scrubber through which waste gases are directed to flow by said chimney.

30. In an incinerator apparatus as in claim 26, container means beneath said accumulator chamber to receive and store unburned particles separating from the waste gases, and means venting said container and accumulator chamber to the atmosphere.

31. The method of cleaning and utilizing the waste gases of an incinerator apparatus having a chimney comprising directing waste gases flowing from an incinerator substantially directly upward to a scrubber higher than the incinerator to encourage the waste gases to increase their velocity of flow from the incinerator, heating the waste gases at the scrubber to a temperature higher than that of the temperature of the waste gases before the waste gases are directed to the scrubber to burn and consume particles in the flowing waste gases to free the gases of such particles and to further increase their upward velocity of flow, diverting the flow of the higher heated waste gases in an downward direction to impart a turbulation and velocity of downward movement to any particles remaining in the waste gases, and emptying the downward moving waste gases into a chamber having a volume greater than a given cross-section of the chimney to permit the waste gases to expand therein and to enable the particles in the waste gases to lose their velocity so as to separate from the waste gases before the waste gases exhaust into the atmosphere through the chimney.

32. A method of cleaning and utilizing the waste gases as in claim 31, directing the waste gases to flow from the chamber along paths each of which extracts the latent heat of the waste gases for the performance of work thereby.

33. A method of cleaning and utilizing the waste gases as in claim 31, turbulating the waste gases and particles remaining in the waste gases by diverting the flow of the higher heated waste gases in a direction that is downward into the chamber from an outlet at the top of the scrubber.

34. A method of cleaning and utilizing the waste gases as claim 33, redirecting some of the higher heated waste gases from the chamber back to the scrubber to add to the scrubber the higher heat of the waste gases of the chamber to aid in the burning and consumption at the scrubber of the particles in the waste gases and to maintain a continuous flow of waste gases through the scrubber to provide a constant draft therethrough.

35. A method of cleaning and utilizing the waste gases as in claim 34, pressurizing the redirected waste gases in their flow to the scrubber from the chamber.

36. A method of cleaning and utilizing the waste gases as in claim 31, venting some of the waste gases from the chamber to the atmosphere, and capturing the remaining particles after they separate from the waste gases in the chamber.

37. In an apparatus for cleaning waste gases, a source of waste gases, a scrubber substantially directly above said source and having means to burn residue and other particles entrained in the waste gases to consume the same and to heighten the temperature of the waste gases, a chimney connected with said source and defining a path along which the waste gases flow from said source to said scrubber, a heat accumulator chamber connected with said chimney and being of a volume greater than a given cross-section of said chimney to receive the higher temperature waste gases from said scrubber and to enable the same to expand therein to release their heat and particles therein, and means connected between said scrubber and said heat accumulator chamber recycling the higher temperature waste gases from said chamber to said scrubber to maintain a draft of hot waste gases flowing through said scrubber in supplement of the waste gases flowing to said scrubber from said source.

38. In an apparatus for cleaning waste gases as in claim 37, said connecting means including means to pressurize the flow of waste gases from said chamber to said scrubber to aid in burning and consuming residue and particles entrained in the waste gases in said scrubber and to effect a continuous cycling of hotter waste gases into said scrubber from said chamber to aid in flowing the waste gases along said chimney from said source.

* * * * *